United States Patent [19]

Hosono et al.

[11] 4,387,664

[45] Jun. 14, 1983

[54] DEVELOPING APPARATUS FOR ELECTROSTATIC IMAGE

[75] Inventors: Nagao Hosono, Shizuoka; Koichi Kinoshita, Narashino; Toru Takahashi, Tokyo, all of Japan

[73] Assignee: Canon Kabushiki Kaisha, Tokyo, Japan

[21] Appl. No.: 340,298

[22] Filed: Jan. 18, 1982

Related U.S. Application Data

[60] Division of Ser. No. 267,771, May 28, 1981, which is a continuation of Ser. No. 938,494, Aug. 31, 1978, abandoned.

[30] Foreign Application Priority Data

Sep. 10, 1977 [JP] Japan ..... 52-109240
Sep. 10, 1977 [JP] Japan ..... 52-109241

[51] Int. Cl.[3] ..... G03G 15/09

[52] U.S. Cl. ..... 118/658; 355/3 DD

[58] Field of Search ..... 118/657, 658; 355/3 DD

*Primary Examiner*—Bernard D. Pianalto
*Attorney, Agent, or Firm*—Fitzpatrick, Cella, Harper & Scinto

[57] ABSTRACT

A developing device for electrophotography includes a developer supporter faced to an image bearing member with a constant space maintained therebetween, a developer supply a magnetic field generator for generating a fixed magnetic field and a magnetic element provided within the magnetic field generated by the generator and in the vicinity of the developer supporter to limit the thickness of developer which is rendered erect by the magnetic field. The element is effective to limit the thickness of developer supported on the supporter to a value not causing contact of the developer with the non-imaged area on the image bearing member.

17 Claims, 6 Drawing Figures

DEVELOPING APPARATUS FOR ELECTROSTATIC IMAGE

This is a division of application Ser. No. 267,771, filed May 28, 1981, which is a continuation application of U.S. Ser. No. 938,494 filed Aug. 31, 1978, now abandoned.

BACKGROUND OF THE INVENTION

1. Field of the Invention

The present invention relates to an apparatus for developing an electrostatic image, and more particularly to a developing apparatus wherein a magnetic field is formed for using a magnetic developer (hereinafter also called magnetic toner) for the image development and the thickness of layer of said toner on a toner carrying member can be limited.

2. Description of the Prior Art

The conventional methods employed in the developing apparatus in electrophotography and electrostatic recording can be classified into dry developing methods and wet developing methods. The former can further be classified into those utilizing a two-component developer and those utilizing a single-component developer. The two-component methods include, according to the classification by the species of carrier employed in combination with the toner, a magnetic brush method utilizing iron power carrier, a cascade developing method utilizing bead carrier, a fur brush method utilizing a fur brush etc. Also the single-component methods include a powder cloud method in which the toner particles are used in a state of sprayed cloud, a contact development or toner development method in which toner particles are brought into direct contact with a surface carrying electrostatic image, a jumping development method in which the toner particles are not brought into direct contact with said surface but are electrically charged and made to fly toward said surface by the electric field of the electrostatic image, a magnetic dry developing method in which magnetic electroconductive toner particles are brought into contact with the surface carrying the electrostatic image etc.

The two-component developing methods employing a mixed developer consisting of carrier particles and toner particles of which the latter are consumed in much larger proportion than the former to alter the mixing ratio of said particles with the progress of development, is fundamentally associated with the drawbacks of the fluctuation of image density resulting from said change in the mixing ratio and the deterioration of image quality resulting from the deterioration of carrier particles which remain unconsumed for a prolonged period.

On the other hand, among the single-component developing methods, the magnetic dry developing method utilizing magnetic toner and the contact developing method not utilizing magnetic toner both involve indiscriminate contact of toner particles with the entire surface to be developed, image area and non-image area inclusive, which tends to cause toner deposition even in the non-image area, thus resulting in so-called background fog. Such background fog is also unavoidable in the two-component developing methods. Also the powder cloud method is associated with said background fog resulting from deposition of toner particles in powder cloud state onto the non-image area.

As a single-component developing method there is already known so-called jumping development method as disclosed in the U.S. Pat. Nos. 2,839,400 and 3,232,190 wherein a toner carrying member such as a sheet member uniformly coated with toner particles is maintained at a small distance from a surface carrying an electrostatic image, and the toner particles are attracted from said carrying member toward said image carrying surface by means of the electric charge of electrostatic image thereby performing the development of said image. The above-mentioned method is advantageous in that it is almost free from the above-mentioned background fog as the toner particles is not attracted in the non-image area having no electrostatic charge nor brought into contact with the non-image area, and also in that it is free from the above-mentioned change of mixing ratio and also from the deterioration of carrier particles since there are no carrier particles involved.

However, the above-mentioned method have been associated with other drawbacks which are enumerated in the following:

(1) Difficulty in obtaining practically uniform toner coating. Uniform toner deposition is difficult to obtain although the toner carrying sheet is previously provided with an electric field to facilitate toner deposition. Different from liquid coating, a thin and uniform coating of particles is difficult to achieve for example with a known rigid blade. Uneven coating is not suitable for practical image reproduction as the unevenness is directly reproduced on the developed image. As an improvement it has been proposed to use a cloth or paper as the toner carrying sheet and embedding the toner particles into the fibers thereof, but it is still difficult to obtain a uniform coating as the toner particles finer than the fiber size is difficult to prepare. Also the toner deposition onto the toner carrying sheet by cascade developing method is not practical as it requires a large-sized apparatus.

(2) Difficulty in uniform toner removal from the toner carrying member. The coated toner layer, when brought into facing relationship with the electrostatic image, should cause uniform removal and transfer of toner as otherwise uniform image development cannot be expected. Such uniform removal of toner particles depends on the surface characteristics of sheet carrying the toner particles, the coating condition thereon and the characteristics of toner particles, and has never reached the practically acceptable level.

(3) Low image resolution.

In the known jumping development method the toner particles are electrostatically deposited on the toner carrying member, and, even if a relatively thin toner layer is formed on said carrying member, the toner particles are considered to fly toward the surface carrying the electrostatic image by the mutually repulsive charges of said toner particles when the distance to said surface is reduced to approximately 3 mm. However the flight of toner particles over such a wide distance from the toner carrying surface to the image holding surface requires a long time and tends to be influenced by the air stream flowing through the gap, the toner gravity, and the eventual vibration of image carrying surface or toner carrying member, giving rise to deterioration of developed image. Also the electric field of fine lines or fine characters in the electrostatic image does not exactly reach the toner carrying surface, so that there may result thinning of fine lines or fine characters, or significant deterioration of resolution due to the lack of flight of toner particles. On the other hand if said distance is rendered too small, it is again difficult to obtain exact reproduction as the fine lines or fine characters tend to become thicker.

SUMMARY OF THE INVENTION

The object of the present invention, therefore, is to provide an apparatus for developing electrostatic image free from the above-mentioned drawbacks and capable of providing stable image quality with high fidelity. More specifically the object of the present invention is to provide a developing apparatus for developing an electrostatic image constructed:

(a) a form a uniform toner layer by means of a simple device;

(b) to maintain an extremely thin toner layer of a uniform thickness in the developing station; and (c) to form a toner layer allowing uniform release of toner particles toward the surface carrying electrostatic latent image, whereby the toner layer is maintained separate from the non-image area to completely eliminate the background fog, and the toner particles are released from the carrying member thereof so as to form a uniform toner image of an elevated resolution in the image area. The image area on the surface carrying an electrostatic image thereon herein used shall mean an area on which the developer is to be deposited in the developing step, while the non-image area shall mean an area which should be free from toner deposition.

An another object of the present invention is to provide a developing apparatus for electrostatic image comprising a developer supporting means positioned in facing relationship to an electrostatic image carrying means carrying an electrostatic image thereon, a means for maintaining a constant distance between said image carrying means and said developer supporting means, a means for supplying a magnetic developer onto said developer supporting means, a magnetic field generating means for generating a fixed magnetic field, and a means provided in the vicinity of said developer supporting means and within the magnetic field generated by said magnetic field generating means for limiting the thickness of developer increased by the magnetic field to a thickness not causing contact of developer with the non-image area on said image carrying means at least in the developing station.

A still another object of the present invention is to provide a developing apparatus for electrostatic image wherein said magnetic field generating means being a fixed magnet provided behind said developer supporting means, and the poles of said magnet being positioned so as to face said means for limiting the developer thickness which is provided in the vicinity of said developer supporting means.

A still another object of the present invention is to provide a developing apparatus for electrostatic image wherein said means for limiting the developer thickness provided in the vicinity of said developer supporting means being a magnet.

Still other objects and advantages of the present invention will be made apparent from the detailed description thereof to be made in the following with reference to the attached drawings.

DESCRIPTION OF THE PREFERRED EMBODIMENTS

Figure 1:
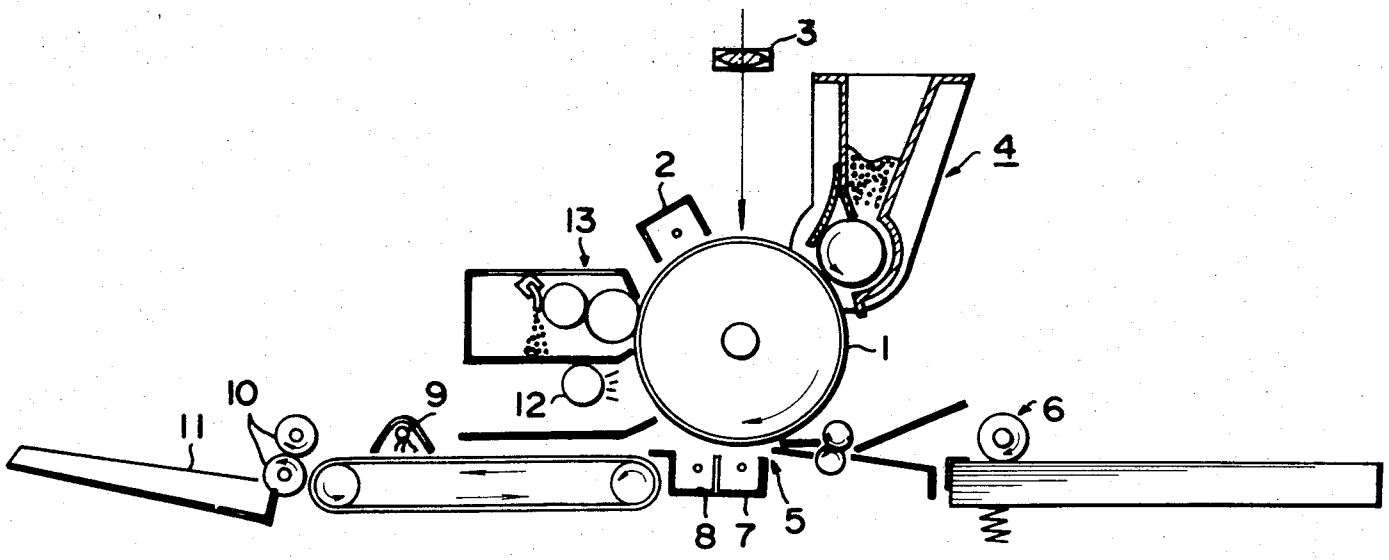
FIG. 1 is a schematic explanatory view of an electrophotographic apparatus utilizing the developing apparatus embodying the present invention.

FIG. 1 schematically shows an example of a copying apparatus or recording apparatus in which the developing apparatus of the present invention is applicable, though the application thereof is naturally not limited thereto.

In FIG. 1 there are shown a photosensitive drum 1 comprising a photoconductive layer which may be provided or not with an insulating layer on the surface thereof and which may be formed in a sheet or a belt, a known sensitizing charger 2, and an image projecting device 3 for projecting an original image, a light image or a light beam modulated by an image signal. By means of the above-mentioned components there is formed and electrostatic image on said photosensitive member 1 through so-called Carlson process, processes disclosed in the U.S. Pat. Nos. 3,666,363 and 4,071,361 or other suitable processes. There is also shown a developing apparatus 4 of the present invention, which forms a visible toner image corresponding to said electrostatic image on said photosensitive member 1. The thus developed visible image is transferred, in a transfer station 5, onto a transfer sheet supplied from a paper feed station 6, wherein 7 indicates a transfer charger. After said transfer, the transfer sheet is subjected to charging for separation by a charger 8, then to heat fixing by a fixing lamp 9 during transportation on a conveyor belt, and ejected by a paper eject roller 10 onto a tray 11 provided outside the apparatus. On the other hand the photosensitive drum 1 is subjected to charge elimination by flash exposure to a lamp 12 and to removal of remaining developer in a cleaning station, thereby being prepared for the next copying cycle. Also in the above-explained apparatus it is possible to employ a so-called electrostatic image transfer process wherein the electrostatic image formed on the photosensitive member 1 is transferred onto another image carrying member and then is rendered visible by the developing apparatus 4.

Figure 2:
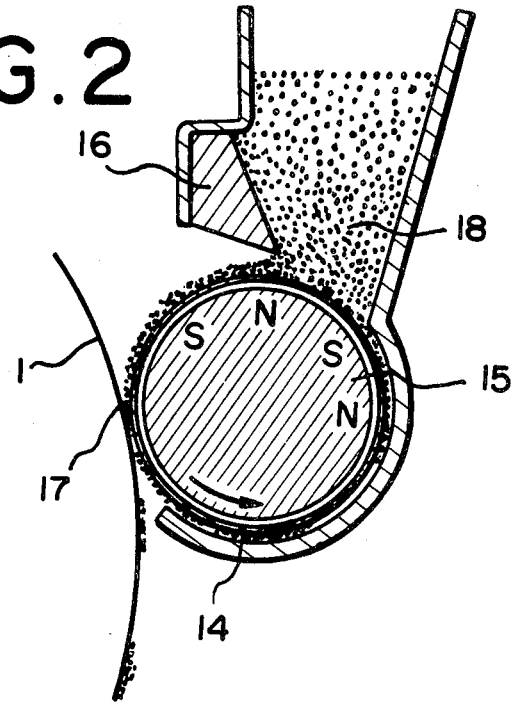
FIG. 2 is a cross-sectional view of an embodiment of the developing apparatus of the present invention.
Figure 3:
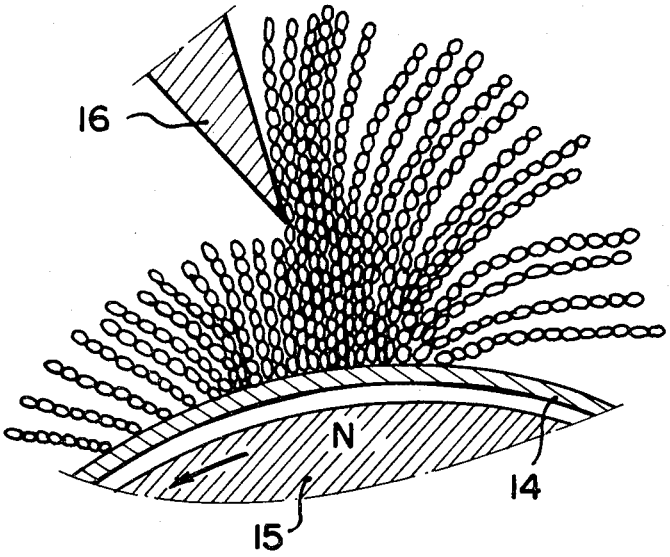
FIGS. 3 and 4 are explanatory views showing the working principles of the developing apparatus of the present invention.
Figure 4:
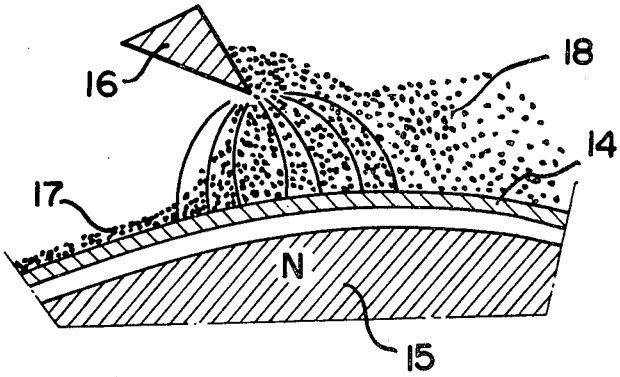

FIG. 2 shows a first embodiment of the developing apparatus of the present invention, wherein there are shown a photosensitive drum 1 functioning as an electrostatic image carrying means which may also be realized in a form of a sheet or belt, a developer supporting means 14 positioned in facing relationship to said carrying means and formed, in the present embodiment, of a non-magnetic cylinder, a magnet 15 positioned rotatably in said cylinder and provided at least with magnetic poles capable of scooping the developer onto said cylinder, further provided preferably with developing magnetic poles functionable at the developing position and further suitably provided with developer carrying poles between the above-mentioned magnetic poles, and a doctor blade 16 for defining the thickness of magnetic toner 18 supplied onto said cylinder. The developer supporting means 14, on which the toner 18 is deposited, is rotated in the direction of arrow while supporting thereon a thin layer of toner thereby developing the latent image on the image carrying means 1 without contacting the non-image area thereof. The thickness of toner layer 17 is limited by the magnet roll 15 and the doctor blade 16, preferably to a value within a range of 30 to 100μ. The magnetic toner particles, in the magnetic field, are mutually linked in a fiber-like state, so that the density thereof is significantly lower than that in ordinary state. Therefore, by limiting the thickness of toner layer inside the magnetic field, it is rendered possible to obtain a thickness much smaller than that obtainable by limiting outside the magnetic field. The limiting with a doctor blade outside the magnetic field has been mechanically difficult as the distance between the blade and the toner supporting means 14 has to be made very small. Also such narrow gap is apt to be clogged with coagulated toner particles and is therefore unable to ensure stable operation. The effect of magnet 15 is recognizable as long as the blade 16 is positioned within the reach of magnetic field of said magnet, but a thinnest limiting is obtainable when the blade faces a magnetic pole as shown in FIG. 3. Also if the blade 16 is formed of a magnetic material, the magnetic field will be concentrated toward said blade 16 to form a curtain of toner particles linked in a brush-like state between the toner supporting member 14 and the blade 16 which blocks the passage of toner 18 except for a small amount dragged by the toner supporting means 14 along the surface thereof, thus forming an extremely thin toner layer 17 as explained in the foregoing. The use of a magnet as the doctor blade 16 further enhances the magnetic field and is therefore more effective, but it is not usable when the magnetic poles of magnet 15 are rotated since the blade made of a magnet, when used in combination with a rotating magnet 15, generates a noise by vibration of blade and increases the rotating torque of said rotating magnet. However a doctor blade 16 made of a magnetic material can be employed in combination with a rotating magnet 15. In this case the blade 16 is alternately approached by different magnet poles to create a strong magnetic field between the blade and the toner supporting means, and the vigorously changing magnetic field thus formed has an effect of decomposing the coagulated toner particles.

Figure 5A:
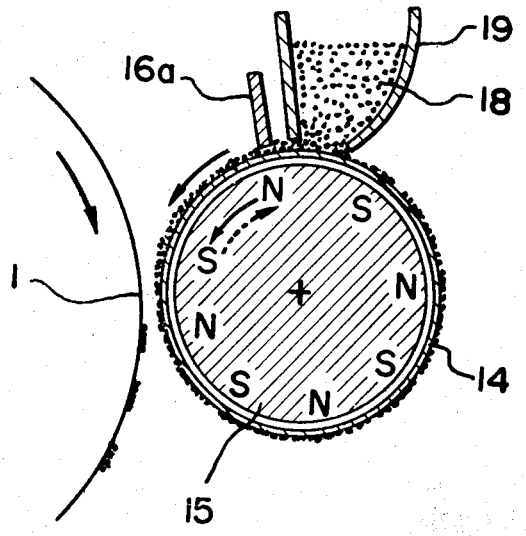
FIGS. 5A and 5B are cross-sectional views of other embodiments of the developing apparatus of the present invention.

In the following there will be explained other embodiments of the developing apparatus according to the present invention shown in FIGS. 5A and 5B, wherein the components common with those shown in FIG. 2 are represented by common numbers. In FIG. 5A the electrostatic image carrying surface 1 is displaced in the direction of arrow, and the non-magnetic cylinder 14 constituting the toner supporting means is driven in the same direction while the multi-pole permanent magnet 15 is rotated in the same or opposite direction whereby the single-component insulating ferromagnetic toner 18 supplied from a toner container 19 is coated on the surface of cylinder 14 and is given an electrostatic charge of a polarity opposite to that of the electrostatic image by means of the friction between said cylinder surface and the toner particles. Also by means of an iron doctor blade **16*a* positioned close to the surface of cylinder (with a distance of 50 to 500μ), the toner layer is limited uniformly and to a small thickness (in a range of 30 to 500μ, preferably 30 to 100μ). The rotating speeds of said non-magnetic cylinder and multi-pole permanent magnet are adjusted in such a manner that the surface speed (and preferably internal speed) of the toner layer becomes substantially equal or close to the speed of said electrostatic image carrying surface 1. To achieve this result, the cylinder may be rotated at substantially the same speed as or a speed slightly lower than that of said image carrying member. In the above-mentioned arrangement the surface of toner layer is separated by a small gap (20 to 400μ) from the image carrying surface 1** whereby a satisfactory image can be obtained by the flight of toner particles across said gap.

In a variation of the foregoing embodiment the image carrying surface 1 is moved in the direction of arrow while the multi-pole permanent magnet 15 is maintained stationary. In this case the non-magnetic cylinder 14 constituting the toner supporting means is rotated in the same direction as said surface 1 whereby the single-component insulating ferromagnetic toner 18 supplied from a toner container 19 is coated on the surface of said cylinder and is given a charge of a polarity opposite to that of the electrostatic image by means of the friction between the surface of cylinder and the toner particles. Furthermore an iron doctor blade **16*a* is provided close to the surface of cylinder (with a gap of 50 to 500μ) so as to face one of the magnetic poles of the permanent magnet 15 thereby limiting the toner layer uniformly and to a small thickness (30 to 300μ, preferably 30 to 100μ). The speed of said cylinder is adjusted in such a manner that the surfacial speed, and preferably the internal speed, of the toner layer becomes substantially same or close to the speed of the image carrying surface. The doctor blade 16*a*** may also be composed of a permanent magnet, instead of iron, to constitute a counter pole.

Figure 5B:
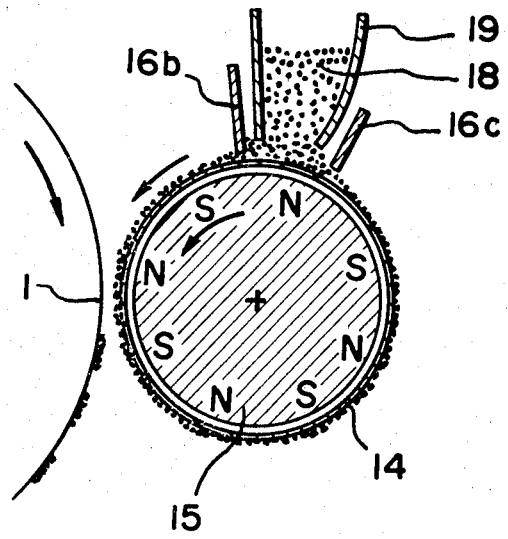
Figure 6:
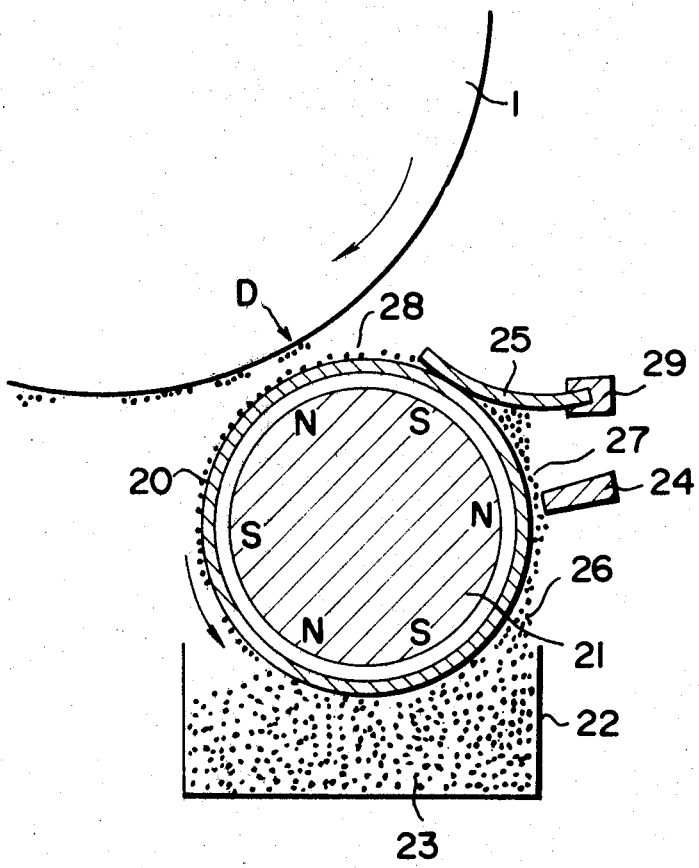
Figure 7A:
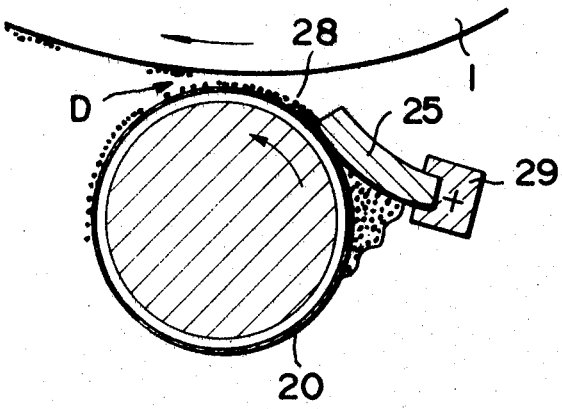
Figure 7B:
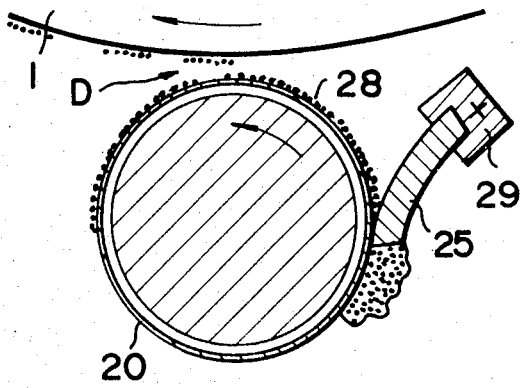
Figure 8:
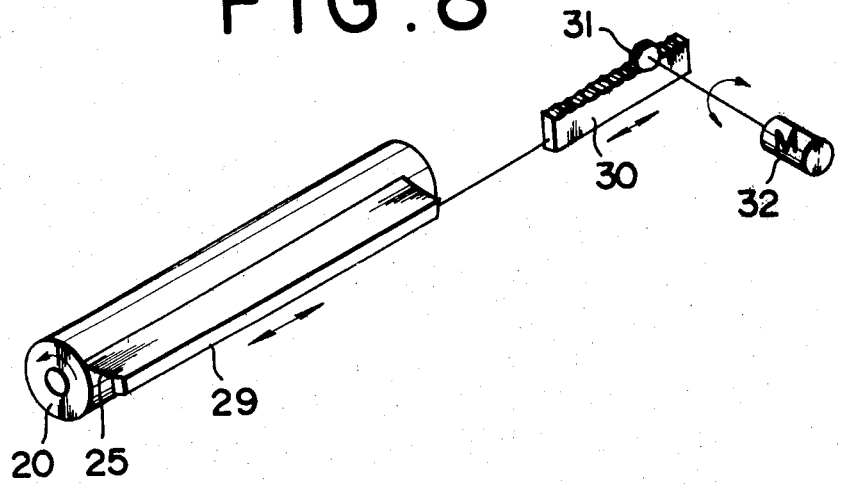
Figure 9:
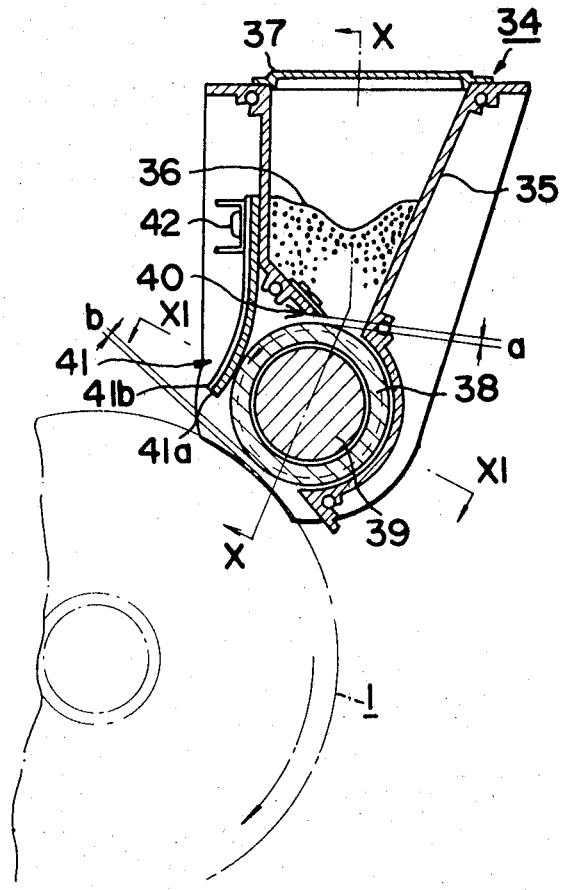
Figure 10:
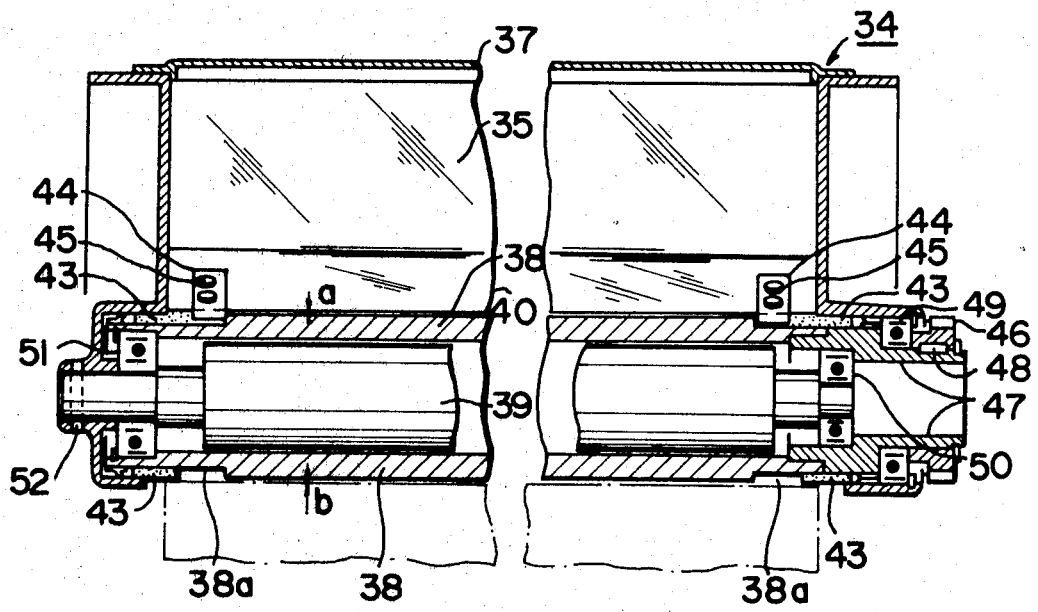
Figure 11:
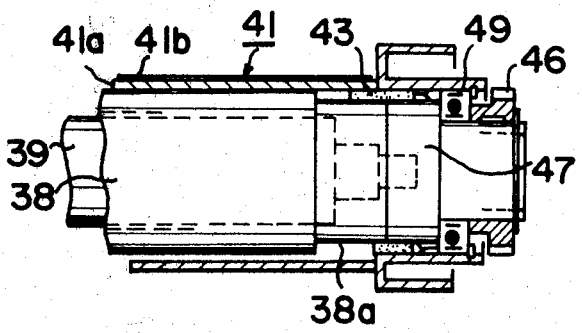
Figure 12:
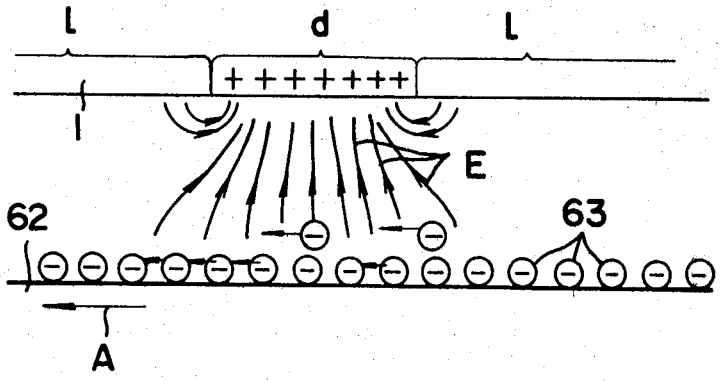
Figure 13:
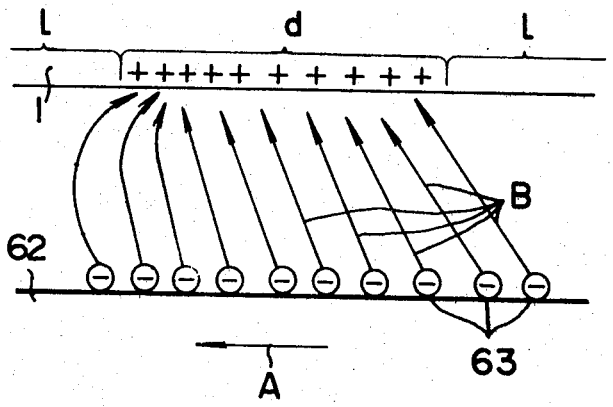

In an embodiment shown in FIG. 5B there are provided two iron doctor blades **16*b*, 16*c* on both sides of the toner container 19. In this case the non-magnetic cylinder 14 constituting the toner supporting means and the magnet 15 are rotated in the same direction as the moving direction of the image carrying surface 1. If the rotating speed of the magnet 15 is sufficiently high, there may result a case wherein the moving direction of the surfacial toner layer is opposite to that of the internal layer. In such case it is found effective, in obtaining a thin toner layer as explained in the foregoing, to use two doctor blades 16*b*, 16*c*** for limiting both the surfacial flow and internal flow of toner.

In the foregoing embodiments the doctor blade may be composed integrally with the toner container, and also may be structured to incline along the surface of cylinder 14. Also the toner supporting means is not necessarily of a cylindrical shape but can also be of a belt shape or any other suitable shape.

The magnetic toner is for example composed of a mixture of 50 parts of polystyrene, 40 parts of magnetite, 3 parts of a charge controlling agent and 6 parts of carbon and formed into particles of an average particle size of 5 to 10μ by a known process, but any other known magnetic toners are naturally usable also for this purpose. The toner supporting member is made of an aluminum cylinder. The magnet is provided with a surface flux density within a range of 600 to 1300 gauss, for example 800 gauss, when a magnetic pole is positioned where the toner supporting member is closest to the image carrying member holding an electrostatic image of a potential contrast of ca. 600 V.

The image development according to the present invention is achieved by the formation of such a toner layer as to be separate from the non-image area of the image carrying surface and as to allow toner transfer in the image area thereof. At said toner transfer, the toner layer facing the image area increases the thickness thereof under the attractive force of electric field and the toner particles develop erect and extending brush-like chains (a phenomenon hereinafter called "toner extension") under the influence of magnetic field in a position corresponding to a magnetic pole, whereby thus extended toner comes into contact with the image area of image carrying surface when it approaches the surface of toner layer and a part of toner remains on said image carrying surface when it is separated from the toner layer, thereby completing the image development. This method, different from so-called contact development or jumping development, is considered to achieve image development by toner contact with the image area through said toner extention while toner is maintained contact-free in the non-image area.

When the distance between the surface of toner layer and the image carrying surface is larger, the image development is considered to be achieved, in addition to the above-explained development by the toner contact through the toner extension, by a phenomenon in which the toner chains extending but not reaching the image carrying surface are also maintained erect in the electric field and the end portion of said chains are torn and fly toward the image carrying surface.

Thus the present invention allows to achieve the image development by the above-mentioned toner extention phenomenon and also the image development by the co-existing toner flight phenomenon according to the distance between the image carrying surface and the toner supporting member. The utilization of said toner extension phenomenon wherein the toner layer is rendered erect and extending to directly contact the image carrying surface in the image area thereof allows to reduce the amount of toner flying across the developing gap, and it is possible to obtain an excellent image quality completely free from background fog when the dimensions of gaps are selected suitably so as to minimize the effect of air stream in said gap, weight of toner, and vibrations of image carrying surface and toner supporting member. In order to ensure satisfactory toner extension, the distance between the image carrying surface and the surface of toner layer in non-extended state in the non-image area should not exceed three times of the toner layer thickness. Also in order to achieve a development principally by said toner extension but also by the co-existing toner flight phenomenon, said distance should not exceed ten times of the toner layer thickness.

Based on the experimental analysis and theoretical analysis including the foregoing explanation, the distance D between the toner supporting member and the electrostatic image carrying surface is preferably within a range from 50 to 500$\mu$, wherein the upper limit is determined from a requirement of reproducing with a satisfactory resolution a character printed with the smallest commercial type-face (100$\mu$), while the lower limit is determined in relation to the thickness of toner layer. Also experimentally the thickness t of toner layer to be supported on the toner supporting member is preferably within a range from 30 to 300$\mu$. At the image development said toner layer is extended under the influence of a magnetic field to a height which is considered to be in the order to three times of said thickness as explained in the foregoing. In order to allow the surface of toner layer to reach the image carrying surface, therefore, the distance s between the surface of toner layer and the image carrying surface should not exceed 300$\mu$. In general satisfactory results are obtained when $s \geqq t/5$. A predetermined distance between the image carrying surface and the toner supporting member can be maintained by a positioning member such as a spacer, a roller and a spring which is in abutment with the image carrying surface or a counter electrode provided therebehind and is engaging with the toner supporting surface.

In addition to the foregoing advantages, the developing apparatus of the present invention, when applied to the copying or recording apparatus utilizing particularly a transfer process, exhibits an extremely excellent transfer effect, thereby enabling to reproduce an image of an extremely high quality without background fog on a plain paper etc.

Naturally the present invention is not limited to the foregoing embodiments but includes the modifications and variations within the scope of the present invention.

What we claim is:

1. A developing apparatus for forming a developed image, comprising:

developer supporting means having a support surface upon which developer may be moved to a developing zone at which said developer supporting means faces a member to which developer is to be transferred for developed image formation;

means for supplying magnetic developer to said support surface;

magnetic field producing means so arranged that in use a portion of the developer supporting means lies between said magnetic field producing means and said developer carried on said support surface, and a stationary magnetic field produced thereby extends across said portion of said developer supporting means through said support surface to attract developer to said support surface; and magnetic means closely spaced from said support surface and disposed within the stationary magnetic field, said magnetic means being adapted and arranged to cooperate with said magnetic field produced by said magnetic field producing means to limit the thickness of the developer carried on said support surface to the developing zone.

2. A developing apparatus according to claim 1, wherein said magnetic field producing means comprises a magnet arranged with a magnetic pole disposed to oppose said magnetic means through said developer supporting means.

3. A developing apparatus according to claim 1 wherein said magnetic means is adapted to concentrate the magnetic field produced by said magnetic field producing means in the region of the developer on said support surface and define a regulating zone.

4. A developing apparatus according to claim 1, wherein said magnetic means comprises a doctor blade of magnetic material.

5. A developing apparatus according to claim 1, wherein the arrangement is such that the thickness of developer carried on said surface to the developing zone is less than the clearance at said developing zone between said developer supporting means and the member to which developer is to be transferred.

6. A developing apparatus according to any one of claims 1 to 5, wherein said magnetic means comprises a magnet.

7. A developing apparatus according to any one of claims 1 to 5, wherein the clearance between said magnetic means and said developer supporting means is not more than 500 microns.

8. A developing apparatus according to any one of claims 1 to 5, wherein said magnetic field producing means comprises a magnetic pole disposed so that in use the portion of said developer supporting means at the developing zone lies between that magnetic pole and the developer carried on said support surface.

9. A developing apparatus according to any one of claims 1 to 5, wherein said magnetic field producing means includes a plurality of magnetic poles for moving the developer on said support surface.

10. A developing apparatus according to any one of claims 1 to 5, wherein the magnetic developer is a one-component developer.

11. A developing apparatus according to any one of claims 1 to 5, wherein the magnetic developer is an insulating developer.

12. A developing apparatus for forming a developed image, comprising:

a developer supporting means having a support surface upon which developer may be moved to a developing zone at which said developer supporting means faces a member to which developer is to be transferred for developed image formation;

means for supplying magnetic developer to said support surface;

magnetic field producing means so arranged that in use a portion of said developer supporting means lies between said magnetic field producing means and the developer carried on said support surface, and a stationary magnetic field produced thereby extends across said portion of said developer supporting means through said support surface to attract developer to said support surface; and magnetic means closely spaced from said support surface and disposed within the stationary magnetic field;

wherein said developer supporting means includes a rotatable sleeve of a non-magnetic material;

wherein said developer supplying means is arranged to supply a one-component insulating developer to said sleeve;

wherein said magnetic field producing means includes a magnet roller which is fixedly disposed within said sleeve and has a developing pole at the developing zone and a plurality of magnetic poles for moving the developer on said sleeve;

wherein said magnetic means includes a doctor blade of a magnetic material; and wherein said magnet roller has a pole at a position opposing said doctor blade through said sleeve such that between said doctor blade and the pole opposing it, a stationary magnetic field is formed.

13. A developing apparatus according to claim 12, wherein said magnetic doctor blade has an edge onto which the magnetic field formed by said magnet roller is concentrated, said edge being spaced from said sleeve by 500 microns or less, and the stationary magnetic field formed between the edge and the opposing pole limits the thickness of the one-component magnetic developer layer on said sleeve to a thickness smaller than the clearance between said sleeve and the member to which the developer is to be transferred.

14. A developing apparatus utilizing powder developer for developing a developable latent image formed on an image carrying member, comprising:

developer supporting member for supporting a layer of magnetic powder developer material adjacent to the image carrying member;

said developer supporting member and image carrying member being, in a developing station, spacially disposed so as to create a space gap therebetween;

magnetic member field generating means for generating stationary magnetic fields;

a magnetic member provided within said stationary magnetic fields and adjacent to the developer supporting member to concentrate said magnetic fields to thereby erect said magnetic developer material along the magnetic fields; and means to move said developer supporting member beyond said magnetic member to form a thin layer of magnetic developer on the developer supporting member, the thin layer of magnetic developer being effective to cause deposition of the developer only onto the image-area of the image carrying member.

15. In a developing apparatus for developing a developable latent image formed on an image carrying member with magnetic powder developer supported on a developer supporting member which is disposed adjacent to said image carrying member so as to create a space gap therebetween; an improvement for forming a thin layer of the magnetic powder developer on the developer supporting member before development of the latent image comprising:

a stationary magnet disposed behind said developer supporting member;

a magnetic doctoring member disposed adjacent to the surface of the developer supporting member to provide a clearance therebetween, the developer layer supported on the developer supporting member being transported to a developing station passing through said clearance;

said magnetic doctoring member being effective to limit the thickness of the developer layer passing through the clearance by stationary magnetic fields formed between said magnet and said magnetic doctoring member to a thickness which will not cause developer deposition onto a non-image area of the image carrying member.

16. In a developing apparatus for developing a developable latent image formed on an image carrying member with magnetic powder developer supported on a developer supporting member which is adjacent to said image carrying member, an improvement comprising:

a magnetic doctoring member disposed adjacent to the developer supporting member to limit the thickness of the developer layer in the presence of a stationary magnetic field toward said magnetic doctoring member.

17. In a developing apparatus for developing a developable latent image formed on an image carrying member with magnetic powder developer supported on a developer supporting member which is adjacent to said image carrying member, an improvement comprising:

a magnetic doctoring member disposed adjacent to the developer supporting member to limit the thickness of the developer layer in the presence of a stationary magnetic field toward said magnetic doctoring member, wherein said magnetic doctoring member is composed of a magnet.

* * * * *

UNITED STATES PATENT AND TRADEMARK OFFICE

CERTIFICATE OF CORRECTION

PATENT NO. : 4,387,664

DATED : June 14, 1983

INVENTOR(S) : NAGAO HOSONO, ET AL.

It is certified that error appears in the above-identified patent and that said Letters Patent is hereby corrected as shown below:

Column 2, line 20, "method" should read --methods--;
line 46, "sheet" should read --the sheet--.

Column 3, line 16, "a form a" should read --to form a--;
line 33, "An another" should read --Another--;
line 51, "A still" should read --Still--;
line 59, "A still" should read --Still--.

Column 6, line 31, "same" should read --the same--.

Column 7, line 18, "extention" should read --extension--;
lines 30,31, "extention" should read --extension--;
line 48, "times of the" should read --times the--;
line 51, "times of the" should read --times the--;
line 67, "order to three" should read --order of three--;"times of said" should read --times said--.

Figs. 6 through 13 of the drawings should be deleted.

Signed and Sealed this

Tenth Day of April 1984

[SEAL]

Attest:

GERALD J. MOSSINGHOFF

Attesting Officer

Commissioner of Patents and Trademarks